United States Patent [19]

Goloff

[11] 4,273,087

[45] Jun. 16, 1981

[54] DUAL FUEL ROTARY CONTROLLED PILOT AND MAIN INJECTION

[75] Inventor: Alexander Goloff, East Peoria, Ill.

[73] Assignee: Caterpillar Tractor Co., Peoria, Ill.

[21] Appl. No.: 102,193

[22] Filed: Oct. 22, 1979

[51] Int. Cl.[3] ..... F02M 43/00

[52] U.S. Cl. ..... 123/299; 123/446; 123/575

[58] Field of Search ..... 123/30 B, 32 G, 139 BC, 123/139 AT, 139 AF, 139 E, 32 AE

[56] References Cited

U.S. PATENT DOCUMENTS

| | | | |
|---|---|---|---|
| 1,156,846 | 10/1915 | Johnson | 123/30 B |
| 1,239,523 | 9/1917 | Rogers | 123/30 B |
| 1,753,253 | 4/1930 | Tacchella | 123/30 B |
| 2,777,433 | 1/1957 | MacCracken | 123/139 BC |
| 2,974,657 | 3/1961 | Bessiere | 123/32 G |
| 3,851,635 | 12/1974 | Murtin et al. | 123/139 E |
| 4,033,314 | 7/1977 | Walton | 123/139 E |
| 4,132,201 | 1/1979 | Bart | 123/139 E |
| 4,180,039 | 12/1979 | Noguchi et al. | 123/139 BC |

FOREIGN PATENT DOCUMENTS

| | | | |
|---|---|---|---|
| 234210 | 12/1944 | Switzerland | 123/139 AT |

*Primary Examiner*—Charles J. Myhre
*Assistant Examiner*—Andrew M. Dolinar
*Attorney, Agent, or Firm*—Phillips, Moore, Weissenberger, Lempio & Majestic

[57] ABSTRACT

PCT No. PCT/US79/00883 Sec. 371 Date Oct. 22, 1979 Sec. 102(e) Date Oct. 22, 1979 PCT Filed Oct. 22, 1979

Pilot injection of a high cetane fuel (16) and main injection of a relatively lower cetane fuel (16*a*) is accomplished by providing dual fuel, rotary controlled, pilot and main injection including a first rotating valve (32) for starting and stopping pilot injection of the high cetane fuel (16) through a first nozzle (46) and for starting main injection of the lower cetane fuel (16*a*) through a second nozzle (46*a*). A second rotating valve (32*a*) stops main injection of the lower cetane fuel (16*a*).

9 Claims, 8 Drawing Figures

DUAL FUEL ROTARY CONTROLLED PILOT AND MAIN INJECTION

DESCRIPTION

1. Technical Field

This invention relates generally to internal combustion engines and more particularly to those having electrically controlled fuel injection.

2. Background Art

Electrical control of fuel injection is versatile and thus advantageous. In general, it allows accomplishment of several important objectives such as excellent control of exhaust emissions; improved engine response; programming of desired torque characteristics of the engine; programming of desired speed regulations; provision for rapid shutdown of engines; and improved fuel economy.

Pilot injection, using a liquid fuel such as diesel fuel, has been used in so called dual-fuel engines to ignite a charge of natural gas. Thus, the use of two separate and different fuels in a given engine is well known.

Another example of a dual fuel engines uses alcohol sprayed into the manifold of a supercharged engine providing aftercooling by evaporating the alcohol. Thus alcohol vapor and air mix and are ignited by a pilot injection of a high cetane fuel.

A rotary controlled fuel injection apparatus has been provided with dual rotary controlled valves for controlling the amount of fuel injected into an engine which reduced inertia forces associated with prior art valves used for fuel injection. These dual rotary valves have been applied to provide pilot and main injection. The prior art discloses electrical means for continuously rotating the dual valves. This electrical means is also disclosed as being capable of independent adjustment of one or both of the valves. In this manner, timing of pilot injection is controlled and both timing and duration of main injection is controlled. The prior art also discloses a well known logic system, for example, the universal fuel injection system, UFIS, which reads and interprets vehicle data such as engine speed, boost or manifold pressure, engine temperature, ambient temperature, altitude, load, etc. The UFIS is powered by the vehicular power system and can provide the appropriate adjustment to the dual rotors for controlling timing and duration of pilot and main injection in response to interpretation of the vehicle data.

A limitation of heretofore known dual rotary controlled fuel injection is that it has not been applied in situations for providing pilot injection of a first fuel and main injection of a second fuel.

The foregoing illustrates limitations of the known prior art. Thus, it is apparent that it would be advantageous to provide an alternative to the prior art. Accordingly, the present invention is directed to overcoming one or more of the limitations as set forth above.

DISCLOSURE OF INVENTION

In one aspect of the present invention, this is accomplished by providing dual fuel, rotary controlled, pilot and main injection including a first rotating valve for starting and stopping pilot injection of a first fuel through a first nozzle and for starting main injection of a second fuel through a second nozzle, and a second rotating valve for stopping main injection of the second fuel.

The foregoing and other aspects will become apparent from the following detailed description of the invention when considered in conjunction with the accompanying drawings. It is to be expressly understood, however, that the drawings are not intended as a definition of the invention but are for the purpose of illustration only.

BEST MODE FOR CARRYING OUT THE INVENTION

Figure 1:
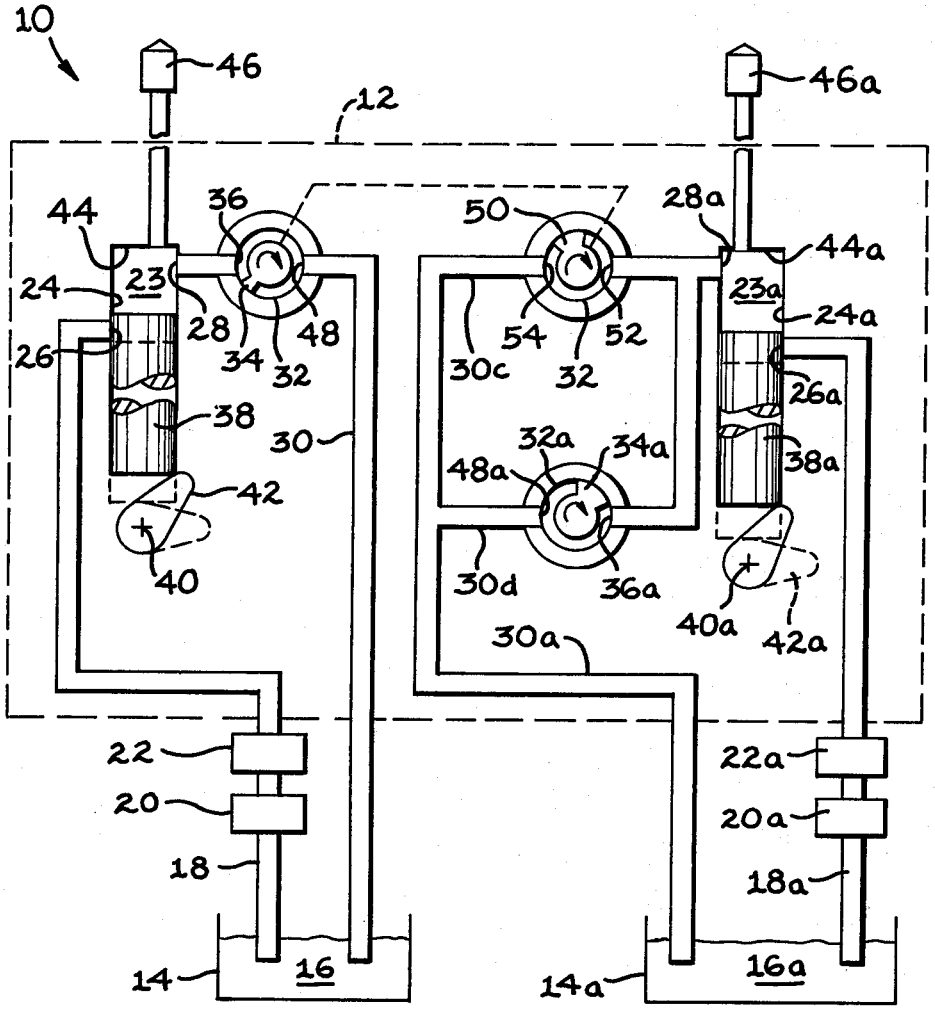
FIG. 1 is a diagrammatic view illustrating the apparatus and system of the present invention.

In FIG. 1 a fuel injection system is generally designated 10 and includes a fuel injection apparatus generally designated 12. System 10 includes a first reservoir 14 for holding a supply of a first fuel 16, an easily ignitable or high cetane fuel to be pilot injected. Fuel 16 is pumped via conduit 18 by a well known pump 20 and preferably through a well known fuel filtering device 22. Conduit 18 delivers pumped fuel 16 to a chamber 23 of a bore 24 through an inlet 26. The pumped fuel 16 exits bore 24 through an outlet 28 and returns to reservoir 14 via a conduit 30. Within conduit 30 is a first valve 32 connected in a well known manner for rotating essentially at a constant speed. Due to the presence of a first blocking shoulder 34 which rotates with valve 32, fuel 16 can be blocked from returning to reservoir 14 via conduit 30 when shoulder 34 closes an inlet 36. A plunger 38, reciprocates in bore 24 in response to rotation of a first camshaft 40 having a lobe 42 which urges plunger 38 toward an end 44 of bore 24 thus closing inlet 26. A pilot injection mode occurs (a) when plunger 38 is moving toward end 44; (b) inlet 26 is closed by plunger 38; and (c) shoulder 34 closes inlet 36. As a result, fuel 16 is momentarily trapped and thus compressed in chamber 23 and injected through a nozzle 46. Pilot injection does not occur when shoulder 34 rotates to close an outlet 48 since, at that time, plunger 38 is moving away from end 44 and fuel 16 is no longer being compressed in chamber 23.

Also in FIG. 1, apparatus 12 includes a second reservoir **14*a* for holding a supply of a second fuel 16*a*, a less easily ignitable, or relatively low cetane fuel for main injection. Fuel 16*a* is pumped via conduit 18*a* by a well known pump 20*a* and preferably through a well known fuel filtering device 22*a*. Conduit 18*a* delivers pumped fuel 16*a* to a chamber 23*a* of a bore 24*a* through an inlet 26*a*. The pumped fuel 16*a* exits bore 24*a* through an outlet 28*a* and returns to reservoir 14*a* via a conduit 30*a*. Within conduit 30*a* are two branch conduits 30*c*,30*d*. Within branch conduit 30*c* is the first valve 32. Due to the presence of a second blocking shoulder 50 which rotates with valve 32, fuel 16*a* can be blocked from returning to reservoir 14*a* via branch conduit 30*c* when shoulder 50 closes an inlet 52. Within branch conduit 30*d* is a second valve 32*a***. Due to the presence of a third blocking shoulder 34*a* which rotates with valve 32*a*, fuel 16*a* can be blocked from returning to reservoir 14*a* via branch conduit 30*d* when shoulder 34*a* closes an inlet 36*a*. A plunger 38*a*, reciprocates in bore 24*a* in response to rotation of a second camshaft 40*a* having a lobe 42*a* which urges plunger 38*a* toward an end 44*a* of bore 24*a* thus closing inlet 26*a*. A main injection mode begins (a) when plunger 38*a* is moving toward end 44*a*; (b) inlet 26*a* is closed by plunger 38*a*; (c) shoulder 34*a* has closed inlet 36*a* and (d) shoulder 50 closes off inlet 52. A main injection mode ends (a) when plunger 38*a* is still moving toward end 44*a*; (b) inlet 26*a* is still closed by plunger 38*a*; (c) shoulder 50 continues to close off inlet 52; and (d) shoulder 34*a* has opened inlet 36. As a result, fuel 16*a* is trapped and thus compressed in chamber 23*a* and injected through a nozzle 46*a*. Main injection does not occur when shoulders 34*a* and 50 rotate to close their respective outlets 48*a*,54 since, at that time, plunger 38*a* is moving away from end 44*a* and fuel 16*a* is no longer being compressed in chamber 23*a*.

Figure 2:
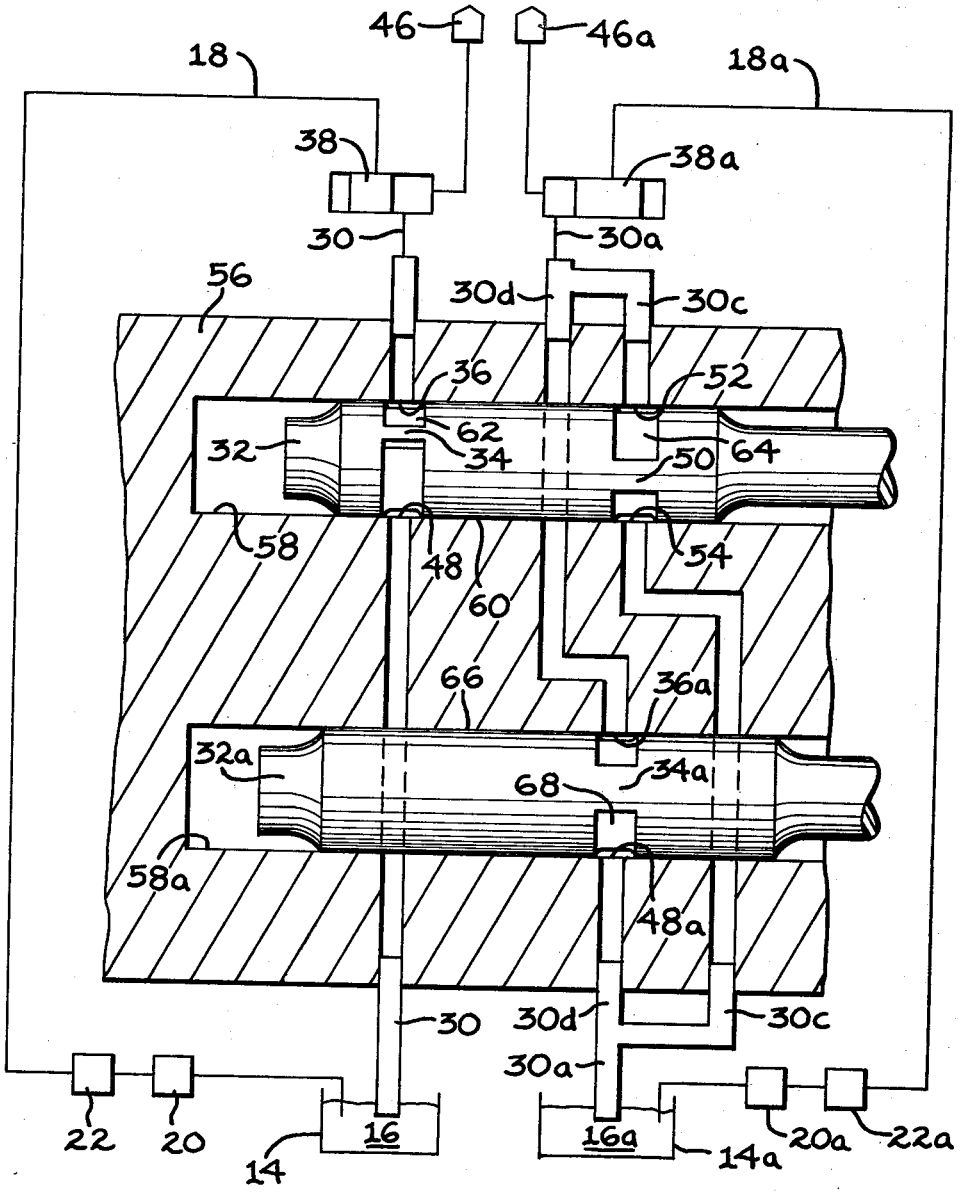
FIG. 2 is a diagrammatic view illustrating the fluidly interconnected rotary valves of the present invention.
Figure 4:
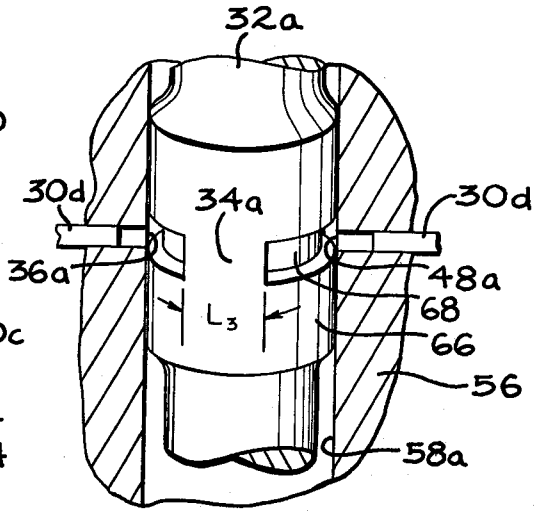
FIG. 4 is an isometric view illustrating the second rotor of the present invention.
Figure 3:
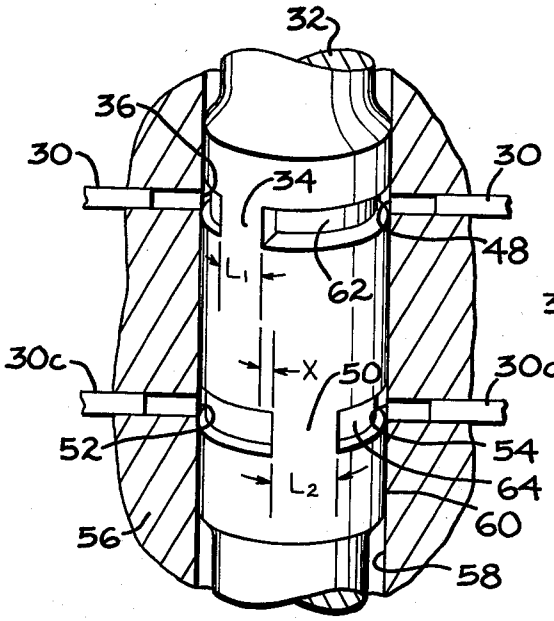
FIG. 3 is an isometric view illustrating the first rotor of the present invention.

In FIGS. 2, 3 and 4, rotary valves 32,32*a* are illustrated in greater detail. Valves 32,32*a* are preferably in a housing 56 including bores 58,58*a*. An outer peripheral surfce 60 of valve 32 rotates in lubricated contact with bore 58 and includes a first groove 62 recessed into surface 60. Blocking shoulder 34 is formed on valve 32 in groove 62 and has a first arcuate length L1 which is of sufficient length to completely close off inlet 36 momentarily as shoulder 34 rotates past inlet 36. A second groove 64 is also recessed into surface 60. Blocking shoulder 50 is formed on valve 32 in groove 64 and has a second arcuate length L2 greater than L1. L2 is of more than sufficient length to completely close off inlet 52 as shoulder 50 rotates past inlet 52. The position of shoulder 50 relative to shoulder 34 is such that there is a fixed timed relationship, represented by a dimension designated X, which, together with properly placed ports 52 and 36, fix the timing between the end of pilot injection caused by shoulder 34 and the beginning of main injection caused by shoulder 50. An outer peripheral surface 66 of valve 32*a* rotates in lubricated contact with bore 58*a* and includes a third groove 68 recessed into surface 66. Blocking shoulder 34*a* is formed on valve 32*a* in groove 68 and has a third arcuate length L3 greater than L1 and L2. L3 is of more than sufficient length to completely close off inlet 36*a* as shoulder 34*a* rotates past inlet 36*a*. The position of shoulder 34*a* may be adjusted relative to shoulder 50 since, as it is known, valves 32,32*a* are relatively adjustable. However, the relative positions of shoulders 34*a* and 50 are such that shoulder 34*a* blocks inlet 36*a* prior to shoulder 50 blocking inlet 52. As a result, fuel 16*a* is first blocked from passage through branch conduit 30*d* and is forced to pass through branch conduit 30*c*. Thus, when shoulder 50 blocks inlet 52, main injection is begun. Further, the relative positions of shoulders 34*a* and 50 are such that shoulder 34*a* opens inlet 36*a* prior to shoulder 50 opening inlet 52. As a result, fuel 16*a* is free to pass through branch conduit 30*d* while shoulder 50 continues to block inlet 52. Thus, when shoulder 34*a* opens inlet 36*a*, main injection ends.

Figure 5:
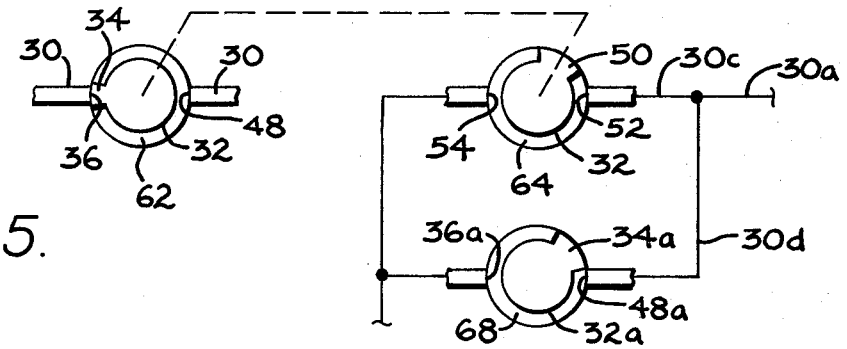
FIGS. 5–8 are partial diagrammatic views illustrating sequential movement of the first and second rotors causing pilot and main fuel injection.

FIGS. 5, 6, 7 and 8 sequentially illustrate pilot and main injection of two fuels 16,16*a*. In FIG. 5, shoulder 34 momentarily blocks inlet 36 thus limiting passage of first fuel 16 through conduit 30 via groove 62 and pilot injection of fuel 16 occurs. At the same time, fuel 16*a* freely passes through conduit 30*a* via branch conduit 30*c* and groove 64 and via branch conduit 30*d* and groove 68, thus no main injection occurs.

Figure 6:
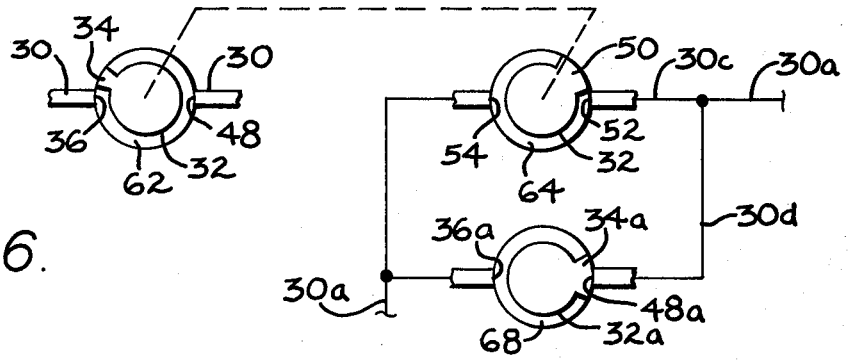

In FIG. 6, shoulder 34 opens inlet 36 thus permitting passage of first fuel 16 through conduit 30 via groove 62 and pilot injection ends. At the same time, fuel 16*a* is blocked from passing through branch conduit 30*d* and groove 68 due to shoulder 34*a* blocking inlet 48*a*. However, fuel 16*a* still freely passes through conduit 30*a* via branch conduit 30*c* and groove 64, thus no main injection occurs.

Figure 7:
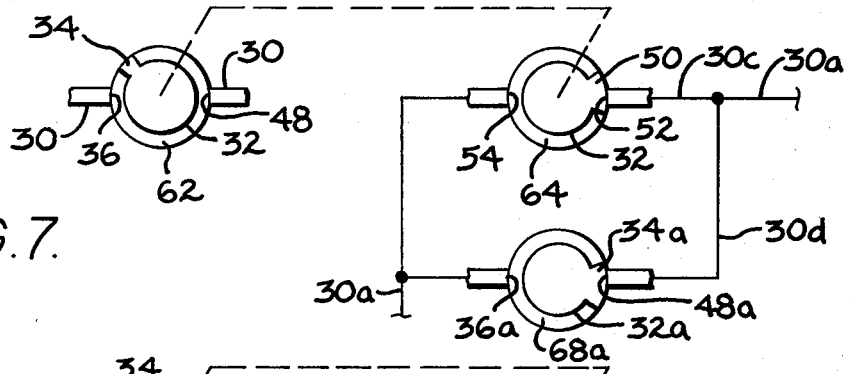

In FIG. 7, shoulder 34*a* still blocks inlet 48*a* thus closing branch conduit 30*d* and simultaneously, shoulder 50 blocks inlet 52 which also closes the free flow of fuel 16*a* through conduit 30*a* via branch conduit 30*c* and groove 64. Thus main injection is begun by shoulder 50.

Figure 8:
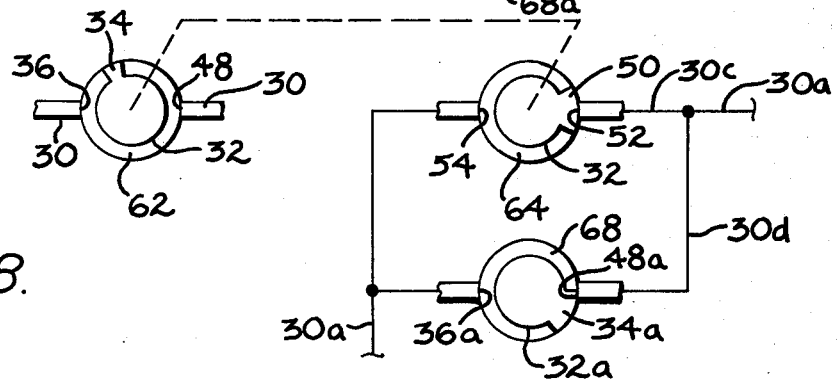

In FIG. 8, shoulder 50 continues to block inlet 52 closing the flow of fuel 16*a* through conduit 30*a* via branch conduit 30*c* and groove 64. However, shoulder 34*a* opens inlet 48*a* and permits free flow of fuel 16*a* through conduit 30*a* via branch conduit 30*d* and groove 68. Thus, main injection is ended by shoulder 34*a*.

Industrial Applicability

The fuel injection apparatus 12 of this invention is applicable in a system 10 providing an easily ignitable or high cetane fuel to be pilot injected followed by a less easily ignitable or relatively low cetane fuel to be main injected. The purpose is to conserve petroleum based fuels and greatly facilitate usage of other fuels such as syncrude, shale oil, methanol, other alcohols, and mixtures of low cetane fuels, etc. The apparatus includes first and second valves 32,32*a*, rotating at essentially constant speed, and two fuel pumps 20,20*a*. The first of the rotors 32 provides pilot injection of a fixed duration, the timing of which is adjustable. The same rotor 32 provides for the starting of main injection, the timing of which is also adjustable in fixed relationship with the timing of pilot injection. The second of the rotors 32*a* provides for stopping main injection. The second rotor 32*a* being adjustable relative to the first rotor 32, permits adjustment of the duration and stopping of main injection. With appropriate modifications, it will be obvious to the skilled artisan that this apparatus may be adaptable to various engines.

The foregoing has described an apparatus having rotary valves for providing pilot injection of a first fuel and main injection of a second fuel.

It is anticipated that aspect of the present invention, other than those specifically defined in the appended claims, can be obtained from the foregoing description and the drawings.

I claim:

1. A fuel injection apparatus comprising:

means for defining a first plunger bore (24);

a first plunger (38) reciprocally mounted in said first plunger bore (24);

means (18,30) for conducting a first fuel (16) to and from said first plunger bore (24);

a first nozzle (46);

means for starting and stopping pilot injection of said first fuel (16) through said first nozzle (46), said means including a rotatable first valve (32) fluidly connected to said first plunger bore (24);

means for defining a second plunger bore (24*a*);

a second plunger (38*a*) reciprocally mounted in said second plunger bore (24*a*);

means (18*a*,30*a*) for conducting a second fuel (16*a*) to and from said second plunger bore (24*a*);

a second nozzle (46*a*);

means for starting main injection of said second fuel (16*a*) through said second nozzle (46*a*), said means including said first valve (32) fluidly connected to said second plunger bore (24*a*); and means for stopping main injection of said second fuel (16*a*), said means including a rotatable second valve (32*a*) fluidly connected to said second plunger bore (24*a*).

2. The apparatus of claim 1 wherein said second valve (32*a*) is fluidly connected to said first valve (32).

3. The apparatus of claim 1 wherein said means for starting and stopping pilot injection of said first fuel (16) includes a first blocking shoulder (34) on said first valve (32).

4. The apparatus of claim 3 wherein said means for starting main injection is a second blocking shoulder (50) on said first valve (32).

5. The apparatus of claim 4 wherein said means for stopping main injection is a blocking shoulder (34*a*) on said second valve (32*a*).

6. A fuel injection apparatus comprising:

a first rotatably mounted camshaft (40);

means for defining a first plunger bore (24);

a first plunger (38) in said first plunger bore (24), said first plunger (38) connected for reciprocating in said first plunger bore (24) in response to rotation of said first camshaft (40);

means (18) for conducting a first fuel (16) to said first plunger bore (24);

a first nozzle (46);

means for starting and stopping pilot injection of said first fuel (16) through said first nozzle (46), said means including a rotatable first valve (32) fluidly connected to receive said first fuel (16) from said first plunger bore (24);

a second rotatably mounted camshaft (40*a*);

means for defining a second plunger bore (24*a*);

a second plunger (38*a*) in said second plunger bore (24*a*), said second plunger (38*a*) connected for reciprocating in said second bore (24*a*) in response to rotation of said second camshaft (40*a*);

means (18*a*) for conducting a second fuel (16*a*) to said second plunger bore (24*a* );

a second nozzle (46*a*); and means for starting and stopping main injection of said second fuel (16*a*) through said second nozzle (46*a*), said means including said first valve (32) and a rotatable second valve (32*a*) fluidly connected to receive said second fuel (16*a*) from said second plunger bore (24*a*).

7. A fuel injection system comprising:

a first reservoir (14) containing a first fuel (16);

means for defining a first plunger bore (24);

a first plunger (38) reciprocally mounted in said first plunger bore (24), said first plunger bore (24) fluidly connected to said first reservoir (14);

a first nozzle (46);

means for starting and stopping pilot injection of said first fuel (16) through said first nozzle (46), said means including a rotating first valve (32) fluidly connected to said first plunger bore (24);

means (30) for returning said first fuel (16) from said first valve (32) to said first reservoir (14);

a second reservoir (14*a*) containing a second fuel (16*a*);

means for defining a second plunger bore (24*a*);

a second plunger (38*a*) reciprocally mounted in said second plunger bore (24*a*), said second plunger bore (24*a*) fluidly connected to said second reservoir (14*a*);

a second nozzle (46*a*);

means for starting main injection of said second fuel (16*a*) through said second nozzle (46*a*), said means including said constantly rotating first valve (32) fluidly connected to said second plunger bore (24*a*);

means for stopping main injection of said second fuel (16*a*), said means including a constantly rotating second valve (32*a*) fluidly connected to said second plunger bore (24*a*); and means (30*a*) for returning said second fuel (16*a*) from said first and second valves (32,32*a*) to said second reservoir (14*a*).

8. A fuel injection apparatus comprising:

means for defining a first bore (24);

a first plunger (38) reciprocally mounted in said first bore (24);

means (18,30) for conducting a first fuel (16) to and from said first bore (24);

a first nozzle (46);

first rotary means (34) for starting and stopping injection of said first fuel through said first nozzle (46), said first rotary means (32) fluidly connected to said first bore (24);

means for defining a second bore (24*a*);

a second plunger (38*a*) reciprocally mounted in said second bore (24*a*);

means (18*a*,30*a*) for conducting a second fuel (16*a*) to and from said second bore (24*a*);

a second nozzle (46*a*);

second rotary means (50) for starting injection of said second fuel (16*a*) through said second nozzle (46*a*), said second rotary means (50) fluidly connected to said second bore (24*a*), and third rotary means (34*a*) for stopping injection of said second fuel (16*a*), said third rotary means (34*a*) fluidly connected to said second bore (24*a*).

9. The apparatus of claim 8 wherein said third rotary means (34*a*) is further fluidly connected to said second rotary means (50).

* * * * *